US009548550B2

(12) United States Patent
Tanaka

(10) Patent No.: US 9,548,550 B2
(45) Date of Patent: Jan. 17, 2017

(54) ELECTRICAL CONNECTOR HAVING A PLURALITY OF CONTACTS AND CAPABLE OF HOLDING THEM IN ALIGNMENT

(71) Applicant: Hosiden Corporation, Yao-shi (JP)

(72) Inventor: Akihiro Tanaka, Yao (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 14/296,118

(22) Filed: Jun. 4, 2014

(65) Prior Publication Data

US 2014/0364011 A1 Dec. 11, 2014

(30) Foreign Application Priority Data

Jun. 6, 2013 (JP) ..... 2013-119965

(51) Int. Cl.

| | |
|---|---|
| ***H01R 12/70*** | (2011.01) |
| ***H01R 13/516*** | (2006.01) |
| ***H01R 13/405*** | (2006.01) |
| ***H01R 13/514*** | (2006.01) |
| *H01R 24/60* | (2011.01) |

(52) U.S. Cl.

CPC ..... *H01R 12/70* (2013.01); *H01R 13/405* (2013.01); *H01R 13/514* (2013.01); *H01R 13/516* (2013.01); *H01R 24/60* (2013.01)

(58) Field of Classification Search

CPC .... H01R 13/516; H01R 13/405; H01R 13/514
USPC ..... 439/626
See application file for complete search history.

(56) References Cited

U.S. PATENT DOCUMENTS

| | | | | |
|---|---|---|---|---|
| 5,200,171 | A * | 4/1993 | Ratcliff | A61K 8/22 424/49 |
| 6,093,061 | A | 7/2000 | Varsik et al. | |
| 6,200,171 | B1 * | 3/2001 | Fusselman | H01R 13/405 29/883 |
| 7,025,605 | B2 | 4/2006 | Lang et al. | |
| 8,961,194 | B2 * | 2/2015 | Ye | 439/69 |
| 2004/0043648 | A1 * | 3/2004 | Houtz | 439/79 |
| 2011/0076894 | A1 | 3/2011 | Hsu et al. | |
| 2011/0263158 | A1 * | 10/2011 | Nishikata et al. | H01R 13/405 439/626 |
| 2012/0045920 | A1 * | 2/2012 | Wu | H01R 9/032 439/345 |
| 2012/0322313 | A1 * | 12/2012 | Hsu et al. | 439/629 |

FOREIGN PATENT DOCUMENTS

| | | | | |
|---|---|---|---|---|
| JP | 2002203626 | A | 7/2002 | |
| JP | 2005524940 | A | 8/2005 | |
| JP | 2005525684 | A | 8/2005 | |
| JP | EP 1930984 | A2 * | 6/2008 | H01R 12/57 |
| WO | 03094302 | A1 | 11/2003 | |
| WO | 03096485 | A1 | 11/2003 | |

* cited by examiner

*Primary Examiner* — Abdullah Riyami
*Assistant Examiner* — Justin Kratt
(74) *Attorney, Agent, or Firm* — The Webb Law Firm

(57) ABSTRACT

Provided is a connector capable of holding a plurality of contacts in alignment. The connector includes a main body, a plurality of contacts to be electrically connected to a connection object and a contact holder holding the plurality of contacts in juxtaposition. The main body includes a fixing portion for fixing the contact holder. The plurality of contacts are fixedly held to the contact holder through integral molding therewith.

1 Claim, 4 Drawing Sheets

ELECTRICAL CONNECTOR HAVING A PLURALITY OF CONTACTS AND CAPABLE OF HOLDING THEM IN ALIGNMENT

CROSS REFERENCE TO RELATED APPLICATION

This application claims priority to Japanese Patent Application No. 2013-119965 filed Jun. 6, 2013, the disclosure of which is hereby incorporated in its entirety by reference.

TECHNICAL FIELD

This disclosure relates to a connector having a plurality of contacts.

RELATED ART

Conventionally, as such a connector described above, there is known one disclosed in Japanese Unexamined Patent Application Publication (Translation of PCT Application) No. 2005-525684. In this connector, a plurality of grooves are formed in a connector housing and conductive terminals (contacts) are supported as being mounted within these respective grooves.

SUMMARY

However, such connector described above, when the number of contacts to be mounted increases, this leads to a decrease in the pitch of the grooves to be formed, which decrease will then lead to reduction in the thickness of an amount of resin to be placed between adjacent grooves (a holding margin for contacts). Consequently, there may arise an inability to press-fit the contacts into a main body in a stable manner. Also, due to thermal deformation of the main body at the time of reflow heating, the contacts can be tilted. This causes decrease in the flatness of the contacts and eventual inability for reliable fixation thereof to e.g. a circuit board or the like.

In addressing to such problems as above, it has been practiced to provide, in an assembly process of contacts, a sizing step or to effect a correcting step through a manual work by a worker. In this case, however, inclusion of such additional step can invite cost increase and/or reduction in production efficiency.

According to one preferred embodiment of the present invention, there is provided a connector having a plurality of contacts and capable of holding them in alignment with each other.

According to one preferred embodiment of the present invention, a connector comprises a main body, a plurality of contacts to be electrically connected to a connection object, and a contact holder holding the plurality of contacts in juxtaposition, wherein the main body includes a fixing portion for fixing the contact holder, and the plurality of contacts are fixedly held to the contact holder through integral molding therewith.

With the above arrangement, after the contacts are fixedly held to the contact holder through integral molding, this contact holder is fixed to the main body. As a result, the main body can hold the contacts, with keeping good juxtaposing alignment thereof. Also, when the main body as holding the contacts is subject to a reflow heating process, it is possible to prevent tilting of the contacts due to thermal deformation of the main body. Further, since the thickness of the respective contact can be changed easily without needing any change in the shape of the main body, it is possible, when needed, to change the thickness of the contact for adjustment of its contacting load.

According to one preferred embodiment of the present invention, the fixing portion includes an aperture in which the contact holder is engaged, and the contact holder includes a projecting portion which comes into contact with an inner circumferential face of the aperture.

With the above arrangement, the projecting portion of the contact holder comes into contact with the inner circumferential face to be fixed thereto. Thus, it is possible to reduce the contacting area of the contact holder to the main body. As a result, even if deformation should occur in the main body due to temporary heating at the time of reflow heating process, it will still be possible to prevent the contact holder from being deformed in suit therewith, so that the juxtaposed contacts can be maintained in good alignment.

According to one preferred embodiment of the present invention, the contact holder includes an exposing portion which exposes at least a portion of the contact.

With the above arrangement, through adjustment of the size and/or position of the exposing portion, the exposed state of each contact can be changed, so that impedance control is made possible.

DESCRIPTION OF EMBODIMENTS

Next, embodiments of a connector according to the present invention will be described with reference to the accompanying drawings.

Figure 1:
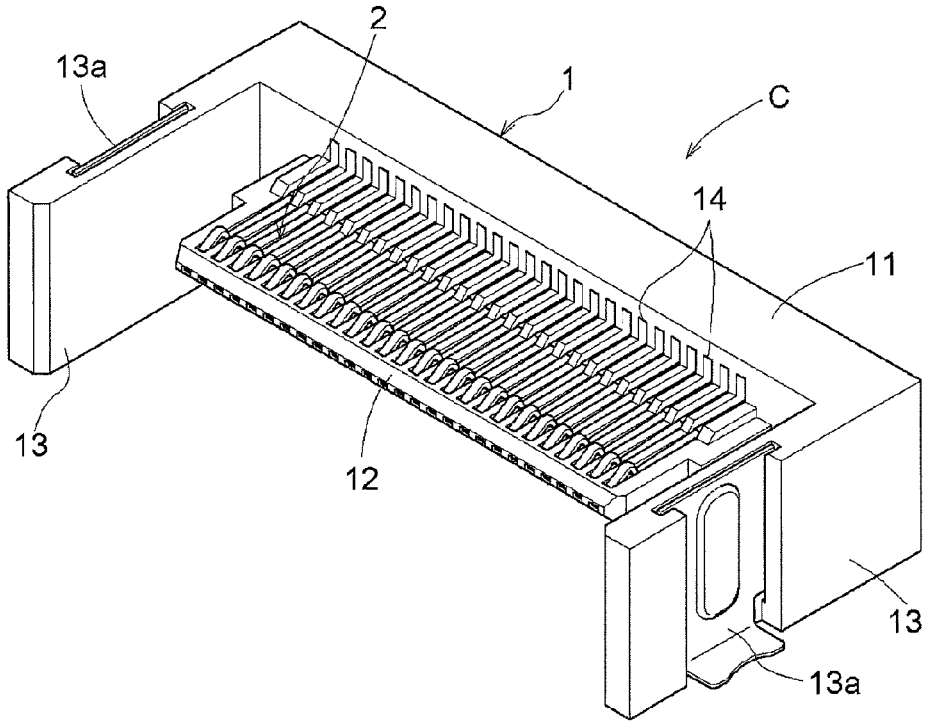
FIG. 1 shows an upper perspective view of a connector according to the present invention.
Figure 2:
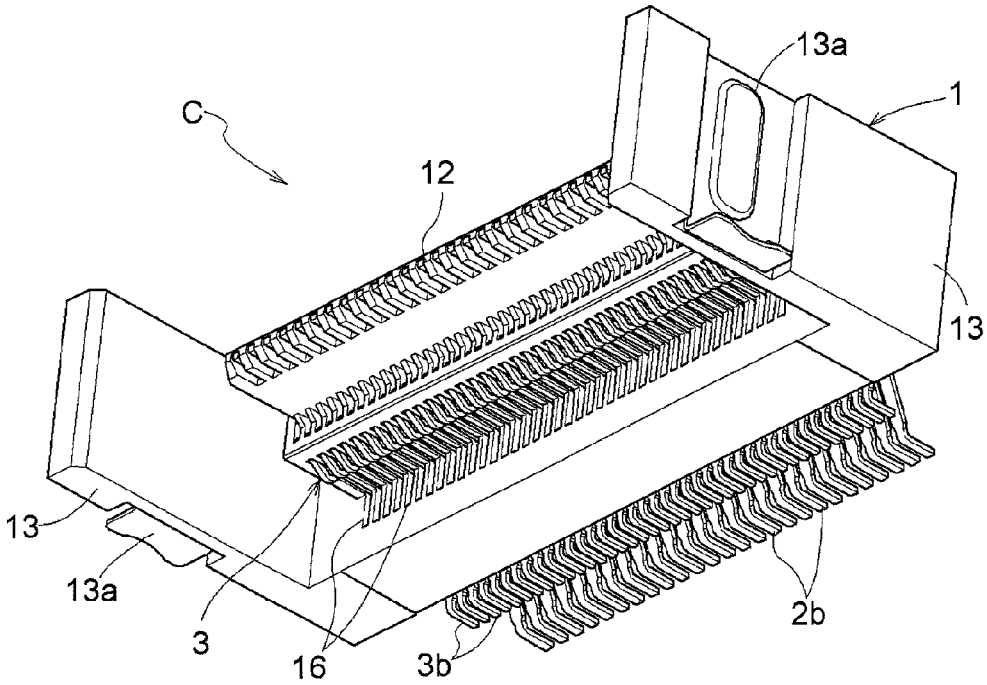
FIG. 2 is a lower perspective view of the connector according to the present invention.
Figure 3:
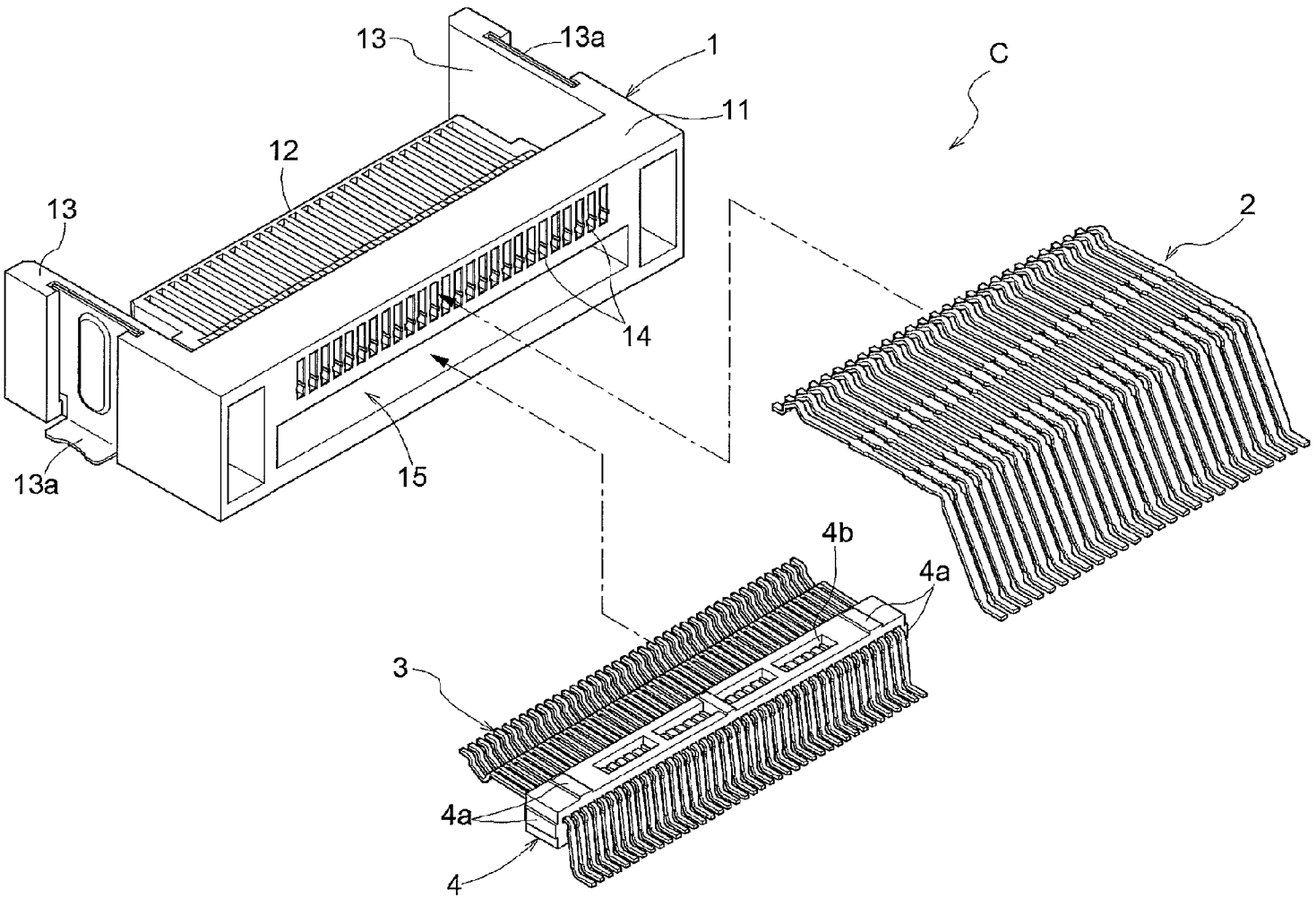
FIG. 3 is an exploded perspective view of the connector according to the present invention.

FIGS. 1 through 3 are an upper perspective view, a lower perspective view and an exploded perspective view of a connector C as one embodiment of the present invention. The connector C includes a main body 1 formed of an insulator such as resin, a plurality of first contacts 2 fixed in juxtaposition to the main body 1, a plurality of second contacts 3 disposed downwardly of the first contacts 2 and held in juxtaposition to the main body 1, and a contact holder 4 holding and fixing the second contacts 3. In the instant embodiment, the connector C is configured to allow selective connection thereto of two different types of connection objects (not shown). When a connection object is connected to the connector C, terminals of the respective connection object come into contact with the first contacts 2 or the second contacts 3. Further, in this embodiment, the number of the second terminals 3 is greater than the number of the first terminals 2.

Incidentally, in the instant embodiment, the upper and lower sides will be defined based on a reference condition wherein the connector C is placed in a state illustrated in FIG. 1. Also, the side (the left side in FIG. 1) on which the connection object is connected to the main body 1 will be defined as the front side.

The main body 1 includes a base portion 11, a holding portion 12 and side walls 13. The holding portion 12 extends forwardly from the front face of the base portion 11. And, the side walls 13 extend forwardly from opposed side portions of the base portion 11 and are formed to sandwich the holding portion 12 from its opposite sides.

The base portion 11, as shown in FIG. 3, includes, in its back face, a fixing portion 15 for fixing the contact holder 4. In this embodiment, the fixing portion 15 is provided in the form of an aperture formed at a lower portion of the rear face of the base portion 11 and having a rectangular cross sectional shape and configured to allow engagement of the contact holder 4 into this aperture.

Grooves 14 are formed to extend from the rear face of the main body 1 to and over the upper face of the holding portion 12. Grooves 16 are formed to extend from the front end face of the fixing portion 15 over to the lower face of the holding portion 12. In this embodiment, the first contacts 12 are held in the grooves 14 and the second contacts 3 are held in the grooves 16 (see FIG. 1, FIG. 2).

In an end face on the outer side of each side wall 13, a reinforcing terminal 13*a* is attached. This reinforcing terminal 13*a* has its lower portion bent at a right angle to the outer side. When this portion is fixed to a circuit board or the like by e.g. solder, fixation of the circuit board or the like to the connector C is reinforced.

Figure 4:
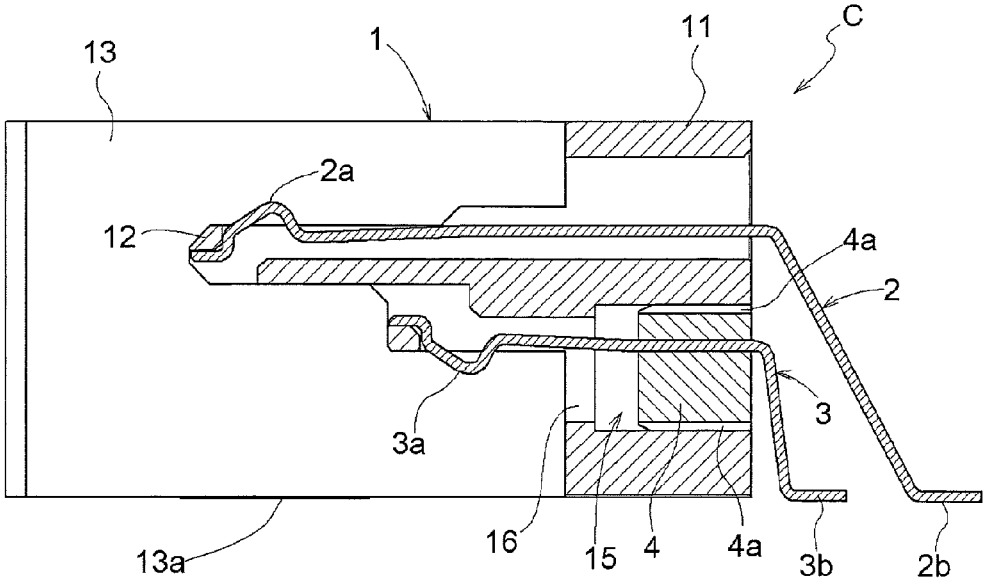
FIG. 4 is a side view in section of the connector according to the present invention.

As shown in FIG. 4, the first contact 2 and the second contact 3 respectively have contact portions 2*a* and 3*a* which respectively come into contact with corresponding terminals of the two types of unillustrated connection objects and also have tail portions 2*b* and 3*b* which respectively are to be fixed to the circuit board or the like by e.g. solder. Each of the first contact 2 and the second contact 3 is provided approximately like a bar; and the contact portion 2*a* has an upwardly convex arch shape whereas the contact portion 3*a* has a downwardly convex arch shape. With such shapes as above, the contact points 2*a*, 3*a* respectively come into contact with and become elastically deformed by the terminals of the two types of connection objects to be connected to the connector C. Also, the tail portions 2*b*, 3*b* of the first contact 2 and the second contact 3 are formed to be bent along the circuit board or the like to which the connector C is fixed and are fixed to the circuit board or the like by e.g. reflow soldering. With these, the respective connection objects and the circuit board or the like can be electrically connected to each other via the connector C.

As described above, the first contacts 2 and the second contacts 3 are held in the grooves 14 and the grooves 16, respectively. Here, as shown in FIG. 3, for the first contacts 2, each one of these is press-fitted into an individual groove 14 from the rear side of the base portion 11. Whereas, the second contacts 3 are configured such that firstly the second contacts 3 and the contact holder 4 are formed integral with each other and thereafter the contact holder 4 to which the second contacts 3 have been fixed is fixed to the main body 1. In this process, the second contacts 3 will be engaged within the grooves 16.

As described above, the number of the second contacts 3 is greater than the number of the first contacts 2. Thus, the forming pitch of the grooves 16 is set narrower that that of the grooves 14 (see FIG. 5). In the case of such arrangement, if the second contacts 3 were directly pressed into the base portion 11 just like the first contacts 2, the contacts 3 would be tilted, thus leading to disadvantageous reduction in the flatness of the first contacts 2 and the second contacts 3, in particular, the flatness of their tail portions 2*b*, 3*b*. Consequently, there may arise failure to provide fixation with keeping good uniformity of the flatness of the tail portions 2*b* and the tail portions 3*b* as a whole.

Moreover, narrow pitch requires certain reduction in the thickness of a resin wall configured to provide electrical insulation between adjacent contacts. And, if the resin wall is formed thin, even when it is attempted to hold the second contact 2 by press-fitting, it will not be possible to provide the second contact 3 with an amount of press-fitting margin sufficient for ensuring required press-fitting strength for the second contact 3. As a result, it will not be possible to secure sufficient contact holding strength. For this reason, in the instant embodiment, as described above, the second contacts 3 are fixed in advance via the contact holder 4 through integral molding and then these are fixed to the main body 1. This arrangement provides not only the possibility of ensuring uniformity in the flatness of the tail portions 2*b*, 3*b*, but also the possibility of ensuring sufficient holding strength of the second contact 3 relative to the contact holder 4.

Figure 6:
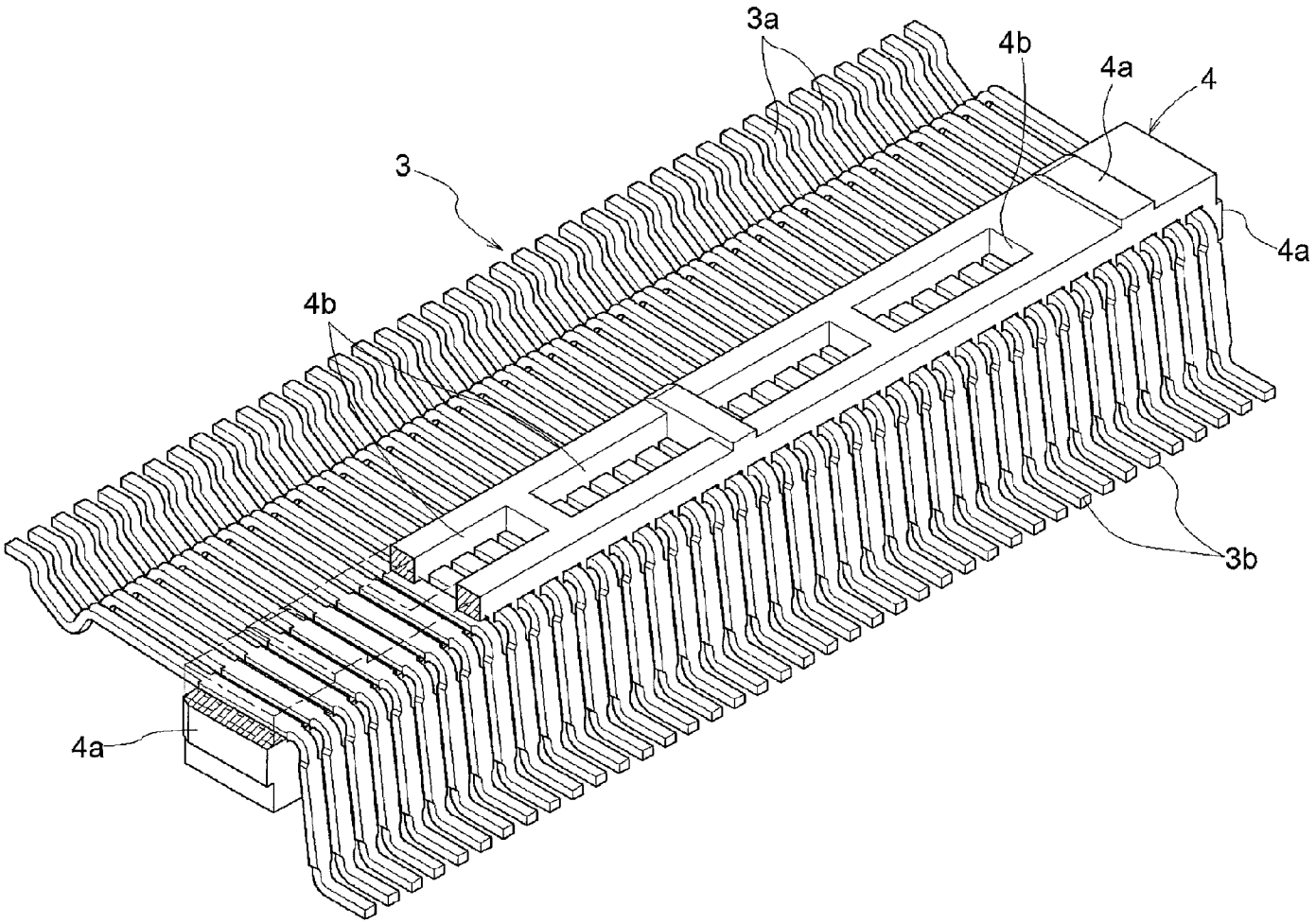
FIG. 6 is a partially cutaway perspective view of a contactor holder provided in the present invention.

As shown in FIG. 6, the contact holder 4 is formed of e.g. resin and has an approximately rectangular parallelepiped shape. And, in the upper and lower faces and the side faces of this contact holder 4, there are respectively provided projecting portions 4*a* extending from the front end to the rear end of each face. Further, in the upper face of the contact holder 4, there are provided exposing portions 4*b* formed as through holes having a rectangular cross sectional shape, so that the second contacts 3 are partially exposed therethrough.

The contact holder 4 and the second contacts 3 are formed integrally by e.g. an insert molding technique. In this way, as the second contacts 3 are fixed in juxtaposition first and then the contact holder 4 is inserted into the fixing portion 15 of the main body 1, the second contacts 3 are caused to be held to the main body 1. With this, even in the case of narrow pitch of contacts, it is still possible to fix the second contacts 3 to the main body 1 in a stable manner. As a result, the tail portions 3*b* of the second contacts 3 will be provided with uniform flatness, which permits in turn reliable soldering fixation of the tail portions 3*b* to the circuit board or the like.

Moreover, it becomes possible to eliminate such additional steps provided conventionally in the assembly process of the connector, e.g. a sizing step for rendering the flatness of contacts uniform, a correcting step by a manual work. Consequently, it becomes possible to reduce the manufacturing costs.

Figure 5:
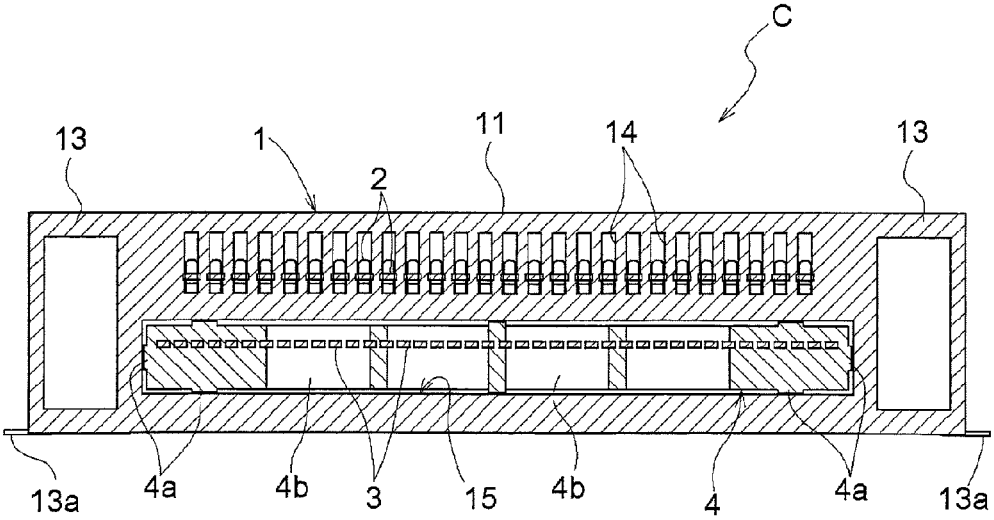
FIG. 5 is a rear view in section of the connector according to the present invention.

FIG. 5 is a rear view in section showing the connector C according to the instant embodiment. As shown, in the instant embodiment, in the contact holder 4, the projecting portions 4*a* provided at multiple portions of this contact holder 4 are fixed as being placed in contact with the inner circumferential face of the fixing portion 15 of the main body 1. Namely, the upper and lower faces and the side faces of the contact holder 4, except for the projecting portions 4*a*, are kept out of contact from the main body 1. With this arrangement, even if deformation occurs in the main body 1 at the time of reflow heating of the connector C, it is possible to prevent the contact holder 4 from being deformed in suit with such deformation of the main body 1. Moreover, thanks to the possibility of thickness reduction of the resin except for the projecting portions 4*a*, it is possible to avoid deformation (shrinkage) due to shrinking of the resin that occurs at the time of insertion molding. Therefore, the flatness of the contacts can be maintained.

As described above, the contact holder 4 includes the exposing portions 4*b* formed to cause the second contacts 3 to be partially exposed therethrough (see FIG. 6). Generally, air and a resin have different dielectric constants from each other. Therefore, impedance control is made possible by changing the size or position of this exposing portion 4*b* for changing the exposed state of the second contact 3. Further, forming the exposing portions 4*b* allows reduction in the volume (amount) of the resin forming the contact holder 4. Thus, it is possible to avoid shrinkage that would otherwise occur at the time of insert molding process. Moreover, if the exposing portions 4*b* are formed as through holes through which the contacts are exposed vertically as provided in the instant embodiment, a mold used for molding these holes at the time of insert molding can sandwich the second contacts 3 vertically for fixing them therebetween. Therefore, this embodiment arrangement is more preferred since it allows prevention of displacement of the contacts due to the flowing pressure of the forming resin.

Furthermore, in the case of an arrangement of press-fitting each individual contact into the main body 1, it will become necessary to change the shape of the main body 1 if it is desired to change the thickness and/or shape of the contact. Whereas, in the case of the arrangement of the instant embodiment wherein the second contacts 3 and the contact holder 4 are formed integral with each other, it is possible to change the thickness and/or shape of the contact as desired without needing to change the shape of the main body 1. Therefore, the spring constant can be changed as desired by a simple operation of changing the thickness of the contact, thus setting a contact load suitable for a particular use and/or using environment contemplated.

Further, in the instant embodiment, as shown in FIG. 6, of each second contact 3, the portion thereof covered by the resin of the contact holder 4 has an increased width. With this, it becomes possible to increase the area of second contact 3 to be fixed by the contact holder 4. As a result, the second contact 3 can be held and fixed to the contact holder 4 in a secure manner.

[Other Embodiments]

(1) In the foregoing embodiment, there was explained the connector C having two kinds of contacts in order to provide connectability to different connection objects. Instead, the connector C can be provided with only one kind of contacts to be connected.

(2) In the foregoing embodiment, the fixing portion 15 for fixing the contact holder 4 is provided in the form of an aperture. However, this can have any desired shape as long as it allows fixation of the contact holder 4 with multiple contacts formed integral therewith to the main body 1.

(3) In the foregoing embodiment, the contact holder 4 is provided with the projecting portions 4*a*. However, these portions can be omitted.

(4) In the foregoing embodiment, the exposing portions 4*b* formed in the contact holder 4 are formed as through holes in the contact holder 4. However, the specific form of these portions is not particularly limited as long as its allows partial exposure of the second contacts 3 therethrough.

(5) In the foregoing embodiment, the contact holder 4 is provided with the exposing portions 4*b*. However, these portions can be omitted.

INDUSTRIAL APPLICABILITY

This disclosure is applicable to a connector having a plurality of contacts.

The invention claimed is:

1. A connector comprising:

a main body;

a plurality of contacts to be electrically connected to a connection object; and a contact holder holding the plurality of contacts in juxtaposition, wherein the main body includes a fixing portion for fixing the contact holder;

wherein the plurality of contacts are fixedly held to the contact holder through integral molding therewith;

wherein the contact holder includes an exposing portion formed as a through hole which extends through the contact holder in a vertical direction to expose at least a portion of the contact in the vertical direction, wherein the fixing portion includes an aperture in which the contact holder is engaged, the aperture having a rectangular cross-sectional shape;

wherein the contact holder includes a plurality of projection portions protruding vertically from upper and lower faces of the contact holder and laterally from side faces of the contact holder; and wherein the contact holder is fixed to the main body with only the plurality of projection portions being in contact with an inner circumferential face of the aperture.

* * * * *